US009169092B2

(12) United States Patent
Koshimura

(10) Patent No.: US 9,169,092 B2
(45) Date of Patent: Oct. 27, 2015

(54) SHEET FEEDING DEVICE, IMAGE FORMING APPARATUS PROVIDED WITH THE SAME, AND IMAGE READING DEVICE PROVIDED WITH THE SAME

(71) Applicant: KYOCERA Document Solutions Inc., Osaka-shi, Osaka (JP)

(72) Inventor: Yuichi Koshimura, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/335,200

(22) Filed: Jul. 18, 2014

(65) Prior Publication Data

US 2015/0034456 A1 Feb. 5, 2015

(30) Foreign Application Priority Data

Jul. 31, 2013 (JP) ..... 2013-158538

(51) Int. Cl.
*B65G 13/02* (2006.01)
*B65H 3/06* (2006.01)

(52) U.S. Cl.
CPC ..... *B65H 3/0638* (2013.01); *B65H 3/0669* (2013.01); *B65H 2404/16* (2013.01); *B65H 2407/21* (2013.01)

(58) Field of Classification Search
CPC ..... B65H 5/06; B65H 5/068; B65H 2801/06; B65H 2404/14; B65H 2404/16; B65H 9/166; B65G 13/065; B65G 13/12; B65G 39/12; B65G 13/10; B65G 13/02
USPC ..... 198/780, 782; 193/37; 400/636; 271/109, 272, 273, 274, 314
See application file for complete search history.

(56) References Cited

U.S. PATENT DOCUMENTS

| | | | | |
|---|---|---|---|---|
| 4,872,661 | A * | 10/1989 | Knepper | 271/273 |
| 5,373,880 | A * | 12/1994 | Koster | 198/782 |
| 5,769,410 | A * | 6/1998 | Davidson et al. | 271/109 |
| 6,059,280 | A | 5/2000 | Yamauchi et al. | |
| 6,279,901 | B1 * | 8/2001 | Fulmer | 271/272 |
| 6,866,264 | B2 * | 3/2005 | Dobrindt | 271/264 |
| 7,731,174 | B2 * | 6/2010 | Lee et al. | 271/109 |
| 8,528,901 | B2 * | 9/2013 | Yamada | 271/274 |
| 2005/0263958 | A1 * | 12/2005 | Knierim et al. | 271/272 |
| 2012/0181744 | A1 * | 7/2012 | Suzuki | 271/243 |
| 2014/0183005 | A1 * | 7/2014 | Meyer et al. | 198/782 |

* cited by examiner

*Primary Examiner* — James R Bidwell
(74) *Attorney, Agent, or Firm* — Gerald E. Hespos; Michael J. Porco; Matthew T. Hespos

(57) ABSTRACT

A sheet feeding device includes a housing, a conveyor roller, a first shaft, a second shaft, and drive units. The conveyor roller includes a first side portion and a second side portion. The first shaft has a first engaging portion. The second shaft has a second engaging portion. The drive units drive and rotate the first and second shafts. The first side portion has an engaged portion to be engaged with the first or second engaging portion. The second side portion is formed with a bearing portion configured to be supported by the first or second engaging portion in relatively rotatable manner. The conveyor roller is mountable in the housing in a first mounted state, in which the conveyor roller is integrally rotated with the first shaft, and in a second mounted state, in which the conveyor roller is integrally rotated with the second shaft.

8 Claims, 9 Drawing Sheets

SHEET FEEDING DEVICE, IMAGE FORMING APPARATUS PROVIDED WITH THE SAME, AND IMAGE READING DEVICE PROVIDED WITH THE SAME

This application is based on Japanese Patent Application No. 2013-158538 filed on Jul. 31, 2013, the contents of which are hereby incorporated by reference.

BACKGROUND

The present disclosure relates to a sheet feeding device for feeding sheets, an image forming apparatus provided with the sheet feeding device, and an image reading device provided with the sheet feeding device.

Conventionally, there is known a sheet feeding device to be loaded in an image forming apparatus for feeding sheets. The sheet feeding device is provided with a sheet tray and a conveyor roller. A sheet of a sheet stack on the sheet tray comes into contact with the circumferential surface of the conveyor roller. When the conveyor roller is rotated, the sheet is conveyed in a predetermined conveyance direction. Further, there is known a technology, in which a conveyor roller is mountable and dismountable to and from a housing of a sheet feeding device.

The sheet feeding device having the above configuration is provided with a drive shaft, a support shaft, and the conveyor roller. The drive shaft is rotatably supported in the housing for transmitting a rotational driving force to the conveyor roller. When the conveyor roller is mounted on a mounting portion disposed in the housing, an engaging portion disposed at a distal end of the drive shaft is engaged with an engaged portion formed on one of the side surfaces of the conveyor roller. Further, the support shaft disposed in the housing is inserted in a bearing portion formed on the other of the side surfaces of the conveyor roller. The engaging portion of the drive shaft is engaged with the engaged portion of the conveyor roller, whereby the conveyor roller is driven and rotated.

SUMMARY

A sheet feeding device according to an aspect of the present disclosure includes a housing, a conveyor roller, a first shaft, a second shaft, and drive units. The conveyor roller is mountable and dismountable to and from the housing, and is driven and rotated in a predetermined rotation direction for conveying a sheet. The conveyor roller includes a first side portion, a second side portion on the side opposite to the first side portion, and an outer circumferential surface disposed between the first side portion and the second side portion and configured to come into contact with the sheet. The first shaft is rotatably and axially supported in the housing. The first shaft includes a first engaging portion at a distal end thereof to be connectable with the first side portion or the second side portion of the conveyor roller. The second shaft is coaxially disposed with the first shaft, and is rotatably and axially supported in the housing. The second shaft includes a second engaging portion at a distal end thereof facing the first engaging portion to be connectable with the first side portion or the second side portion of the conveyor roller. The drive units are respectively connected with the first shaft and the second shaft, and are configured to drive and rotate the first shaft and the second shaft in the rotation direction. The first side portion of the conveyor roller is formed with an engaged portion engageable with the first engaging portion or the second engaging portion for transmitting a rotational driving force from the first shaft or from the second shaft to the conveyor roller. The second side portion of the conveyor roller is formed with a bearing portion configured to be axially supported by the first engaging portion or the second engaging portion in relatively rotatable manner. The conveyor roller is mountable to the housing both in a first mounted state, in which the engaged portion is engaged with the first engaging portion, and the bearing portion is supported by the second shaft in relatively rotatable manner so that the conveyor roller is integrally rotated with the first shaft in the rotation direction, and a second mounted state, in which the engaged portion is engaged with the second engaging portion, and the bearing portion is supported by the first shaft in relatively rotatable manner so that the conveyor roller is integrally rotated with the second shaft in the rotation direction.

An image forming apparatus according to another aspect of the present disclosure includes the sheet feeding device having the above configuration, and an image forming unit. The image forming unit is configured to form an image on a sheet.

An image reading device according to yet another aspect of the present disclosure includes the sheet feeding device having the above configuration, and a reading portion. The reading portion is configured to read an image of a document to be conveyed by the sheet feeding device.

These and other objects, features and advantages of the present disclosure will become more apparent upon reading the following detailed description along with the accompanying drawings.

DETAILED DESCRIPTION

Figure 1:
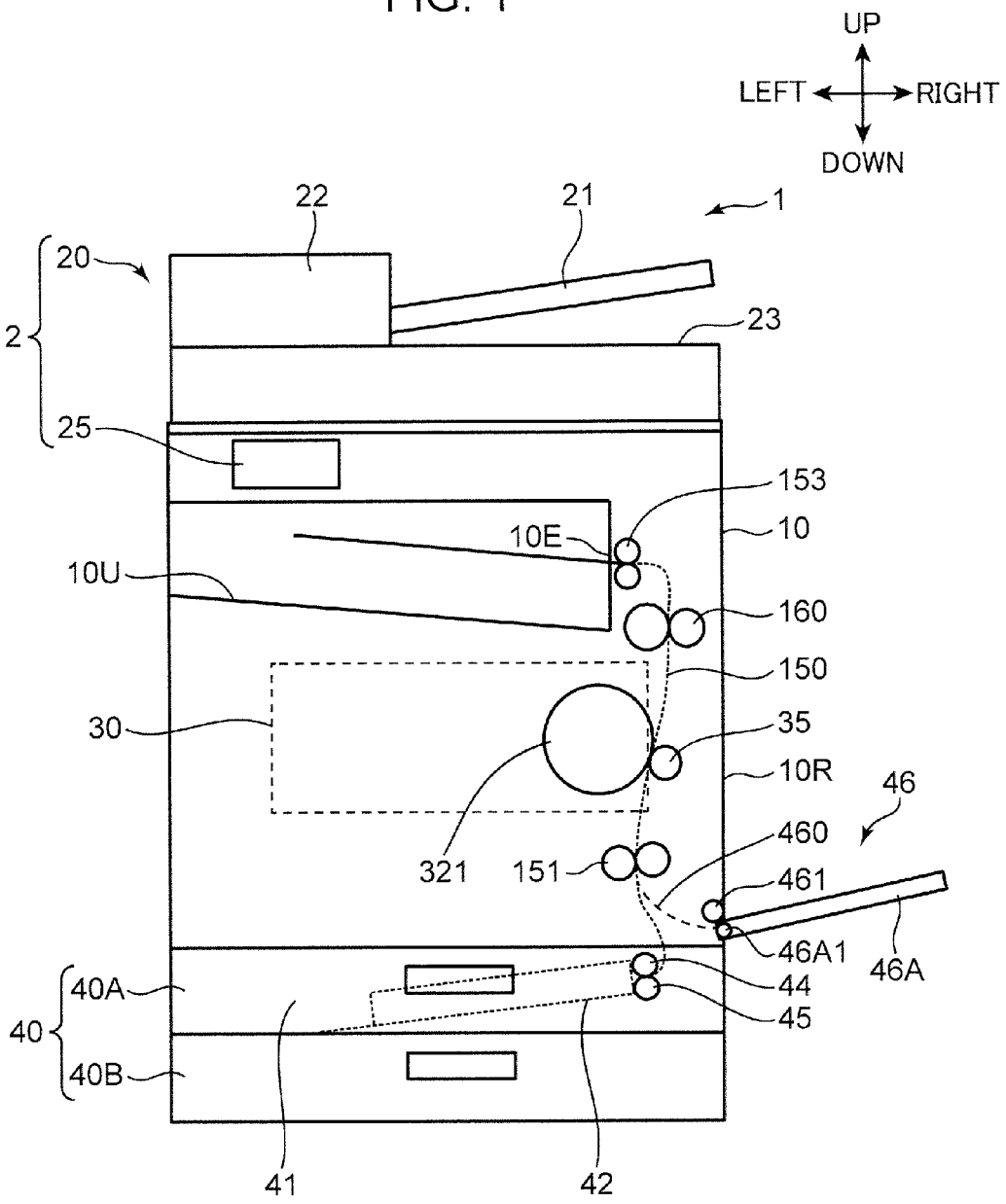
FIG. 1 is a schematic sectional view illustrating a structure of an image forming apparatus embodying the present disclosure.

In the following, embodiments of the present disclosure are described in details referring to the drawings. FIG. 1 is a schematic sectional view illustrating an internal structure of an image forming apparatus 1 embodying the present disclosure. In this example, the image forming apparatus 1 is a complex machine provided with a function of a printer and a function of a copying machine. The image forming apparatus may be a printer, a copying machine, or a facsimile machine.

<Description of Image Forming Apparatus>

The image forming apparatus 1 is provided with an apparatus body 10 having a substantially rectangular parallelepiped housing structure, and an automatic document feeder (ADF) 20 disposed above the apparatus body 10. The apparatus body 10 is internally provided with a reading unit 25 (a reading portion) which optically reads a document image to be copied, an image forming unit 30 which forms a toner image onto a sheet, a fixing unit 160 which fixes the toner image on the sheet, a sheet stacking unit 40 which stores sheets of a fixed size to be conveyed to the image forming unit 30, and a conveyance path 150 along which a sheet of a fixed size is conveyed from the sheet stacking unit 40 or from a manual sheet feeding unit 46 to a sheet discharge port 10E via the image forming unit 30 and the fixing unit 160.

The ADF 20 is pivotally mounted on the upper surface of the apparatus body 10. The ADF 20 automatically feeds a document sheet to be copied toward a predetermined document reading position in the apparatus body 10. On the other hand, in the case where the user manually places a document sheet at the predetermined document reading position, the ADF 20 is opened upwardly. The ADF 20 includes a document tray 21 on which a document sheet is placed, a document conveying unit 22 which conveys the document sheet via the document reading position, and a document discharge tray 23 on which the document sheet after an image reading operation is discharged.

On the upper surface of the apparatus body 10, there is disposed a contact glass for reading a document sheet to be automatically fed from the ADF 20, or a contact glass (not illustrated) for reading a manually placed document sheet. The reading unit 25 is configured to optically read an image of a document sheet through one of the contact glasses. The ADF 20 and the reading unit 25 constitute an image reading device 2 to be described later.

The image forming unit 30 is configured to generate a toner image and form the toner image on a sheet, based on a well-known electrophotographic system. Alternatively, another image forming system such as an ink jet system may be used. The image forming unit 30 includes a photosensitive drum 321, and also includes an unillustrated charger, an illustrated exposure unit, an unillustrated developing device, and an unillustrated cleaning device disposed around the photosensitive drum 321.

The photosensitive drum 321 is configured to rotate about the axis thereof, and to form an electrostatic latent image and a toner image on the circumferential surface thereof The charger is configured to uniformly charge the surface of the photosensitive drum 321. The exposure unit has an optical device such as a laser light source, a mirror, and a lens. The exposure unit is configured to form an electrostatic latent image by irradiating light based on image data indicative of a document image onto the circumferential surface of the photosensitive drum 321. The developing device is configured to supply toner to the circumferential surface of the photosensitive drum 321 for developing an electrostatic latent image formed on the photosensitive drum 321. The cleaning device has a cleaning roller, and is configured to clean the circumferential surface of the photosensitive drum 321 after the toner image transfer. A transfer roller 35 is disposed to face the photosensitive drum 321. A toner image on the photosensitive drum 321 is transferred onto a sheet in a transfer nip portion between the photosensitive drum 321 and the transfer roller 35.

The sheet stacking unit 40 is provided with two cassettes i.e. a first sheet cassette 40A and a second sheet cassette 40B, each of which is configured to store sheets P of a fixed size, out of the sheets of different sizes for image formation. The user is allowed to draw out the first and second sheet cassettes 40A and 40B in a forward direction from the front side of the apparatus body 10.

The first sheet cassette 40A is provided with a sheet storing unit 41 for storing a sheet stack constituted of a stack of sheets P of a fixed size, and a lift plate 42 for lifting up the sheet stack for sheet feeding. An unillustrated pickup roller, and a roller pair constituted of a feeding roller 44 and a retard roller 45 are disposed on an upper portion on the right end side of the first sheet cassette 40A. Driving the pickup roller and the feeding roller 44 makes it possible to dispense the sheet stack in the first sheet cassette 40A one by one from the uppermost sheet P, whereby the uppermost sheet P is conveyed to an upstream end of the conveyance path 150. The second sheet cassette 40B has the same construction as the first sheet cassette 40A.

The manual sheet feeding unit 46 (a sheet feeding device) is provided on a right surface 10R of the apparatus body 10. The manual sheet feeding unit 46 is configured to convey a sheet toward the image forming unit 30. The manual sheet feeding unit 46 is provided with a manual sheet feeding tray 46A for manual sheet feeding, and a sheet feeding roller 461 (a conveyor roller). Sheets are stacked on the manual sheet feeding tray 46A. The manual sheet feeding tray 46A is mounted on the apparatus body 10 to be pivotally opened and closed around a pivot portion 46A1 disposed at a lower end of the manual sheet feeding tray 46A. In the case where the user performs manual sheet feeding, the user opens the manual sheet feeding tray 46A as illustrated in FIG. 1, and places a sheet or sheets on the manual sheet feeding tray 46A. The sheet placed on the manual sheet feeding tray 46A is conveyed to a manual sheet conveyance path 460 (a sheet conveyance path) extending from the manual sheet feeding tray 46A and configured to convey the sheet in a predetermined sheet conveyance direction by driving of the sheet feeding roller 461. The sheet conveyed in the sheet conveyance direction is conveyed from the manual sheet conveyance path 460 to the conveyance path 150. The sheet feeding roller 461 is driven and rotated in a predetermined rotation direction, whereby the sheet is conveyed in the sheet conveyance direction. The sheet feeding roller 461 is disposed to face the downstream side of the manual sheet feeding tray 46A in the sheet conveyance direction.

A registration roller pair 151 is disposed on the upstream side than the transfer nip portion. Conveying of a sheet is temporarily stopped by the registration roller pair 151 in a stopped state for skew correction. Thereafter, the sheet is fed to the transfer nip portion at a predetermined timing for image transfer by driving and rotating the registration roller pair 151 by a drive unit (not illustrated). In addition to the above, plural unillustrated sheet conveyor rollers for conveying a sheet are disposed along the conveyance path 150.

A sheet discharge roller 153 is disposed at a most downstream end of the conveyance path 150. The sheet discharge roller 153 is configured to discharge a sheet P through the sheet discharge port 10E. The sheet P discharged through the sheet discharge port 10E is discharged and stacked on a discharge unit 10U.

The fixing unit 160 is configured to perform a fixing process of fixing a toner image on a sheet. The fixing unit 160 is configured such that a pressing roller comes into pressing contact with a fixing roller, whereby a fixing nip portion is formed. Allowing a sheet to pass through the fixing nip portion makes it possible to fix a toner image transferred to the sheet onto the sheet.

<Description of Sheet Feeding Unit>

Figure 2:
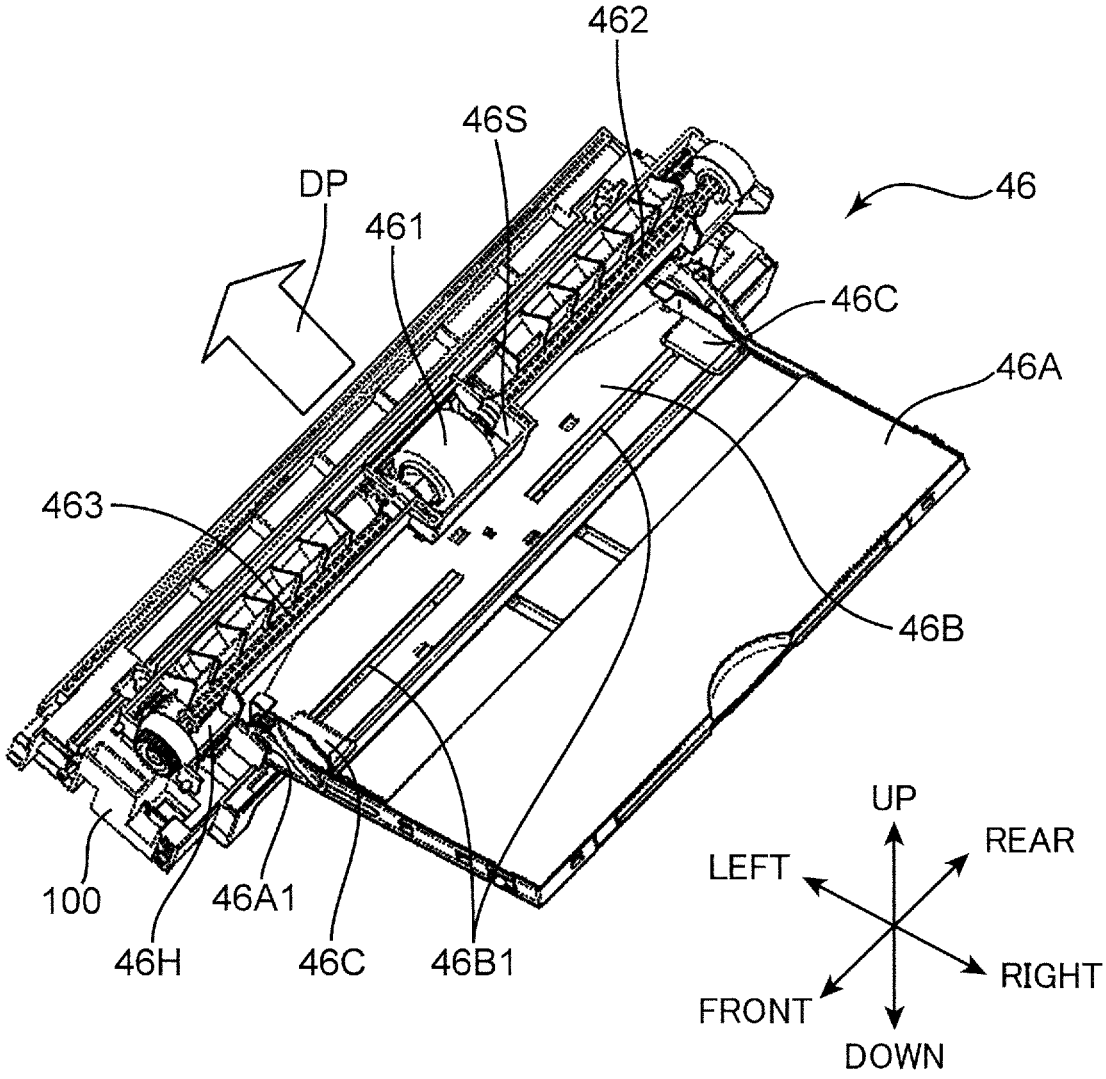
FIG. 2 is a perspective view of a sheet feeding device according to the first embodiment of the present disclosure.
Figure 3:
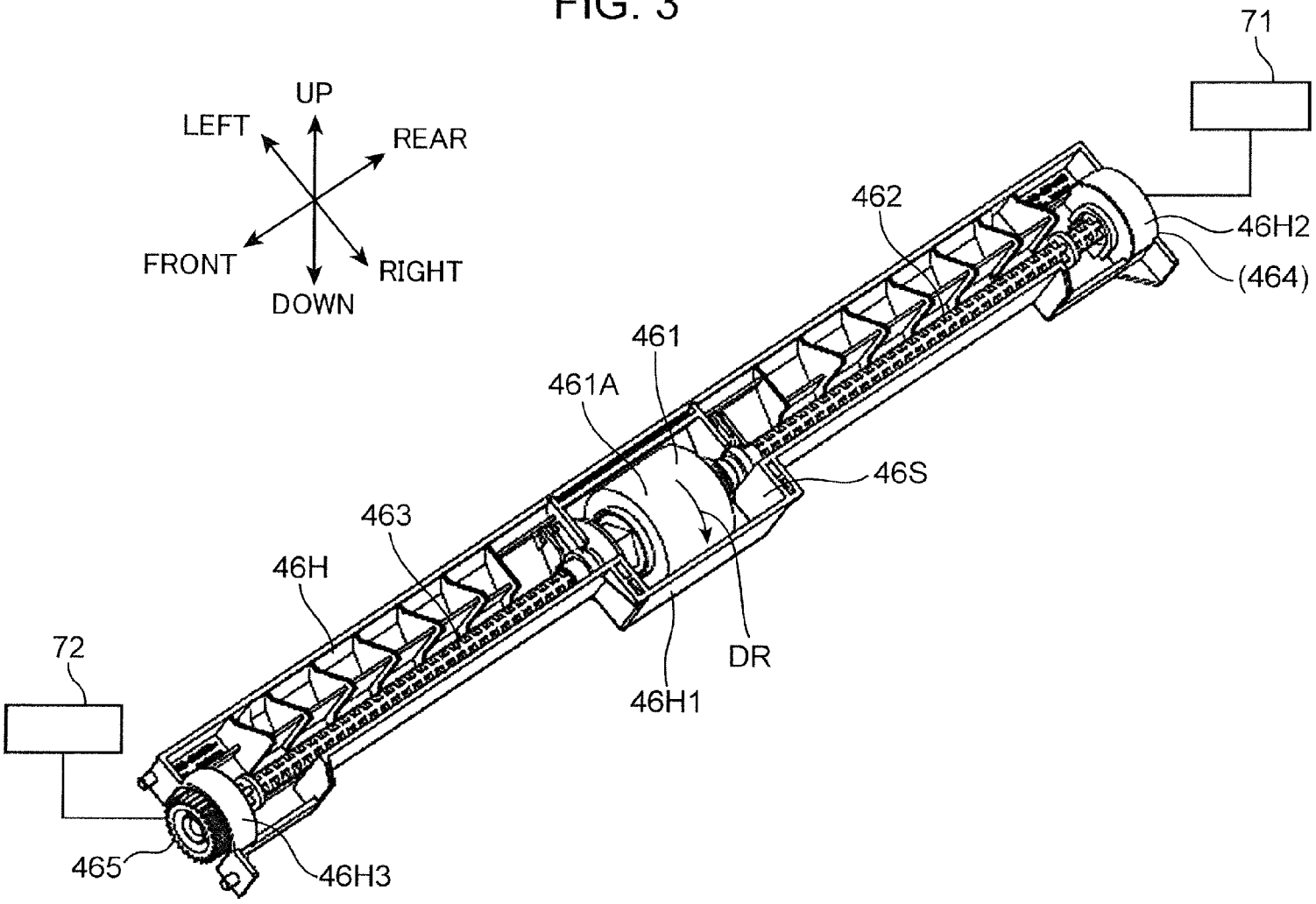
FIG. 3 is a partially enlarged perspective view of the sheet feeding device according to the first embodiment of the present disclosure.
Figure 4:
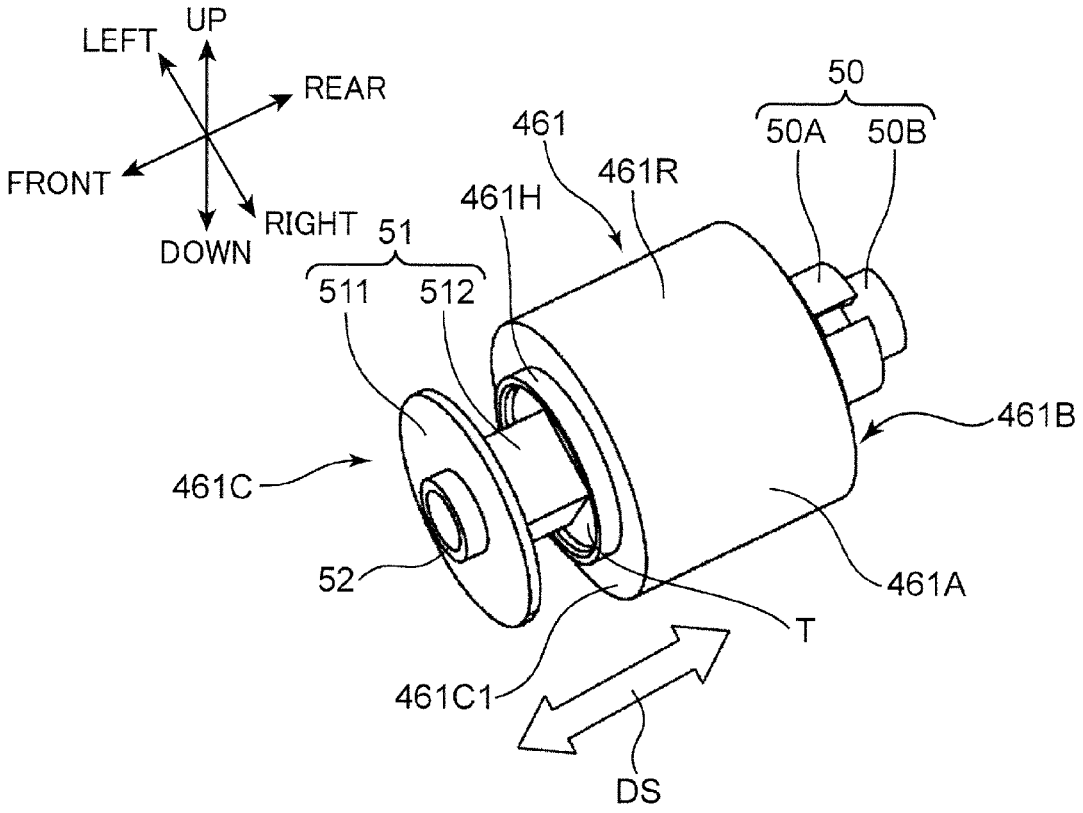
FIG. 4 is a perspective view of a conveyor roller in the first embodiment of the present disclosure.
Figure 5:
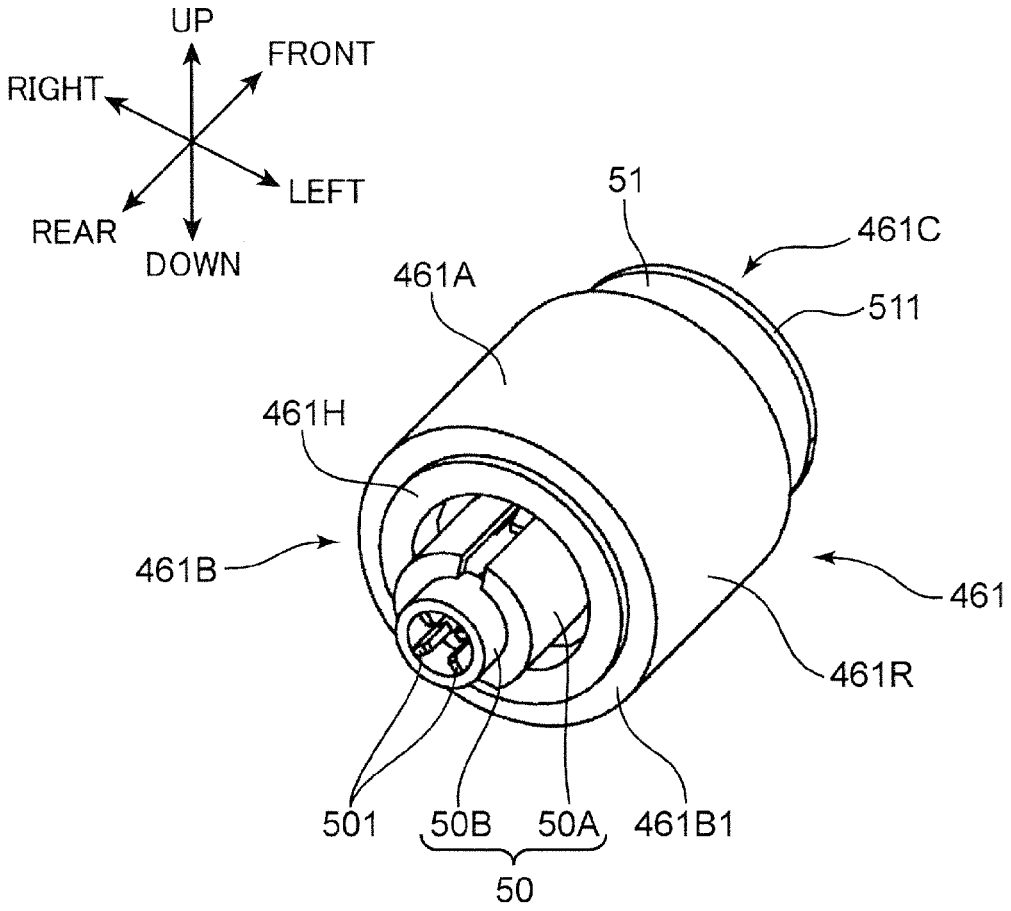
FIG. 5 is a perspective view of the conveyor roller in the first embodiment of the present disclosure.
Figure 6:
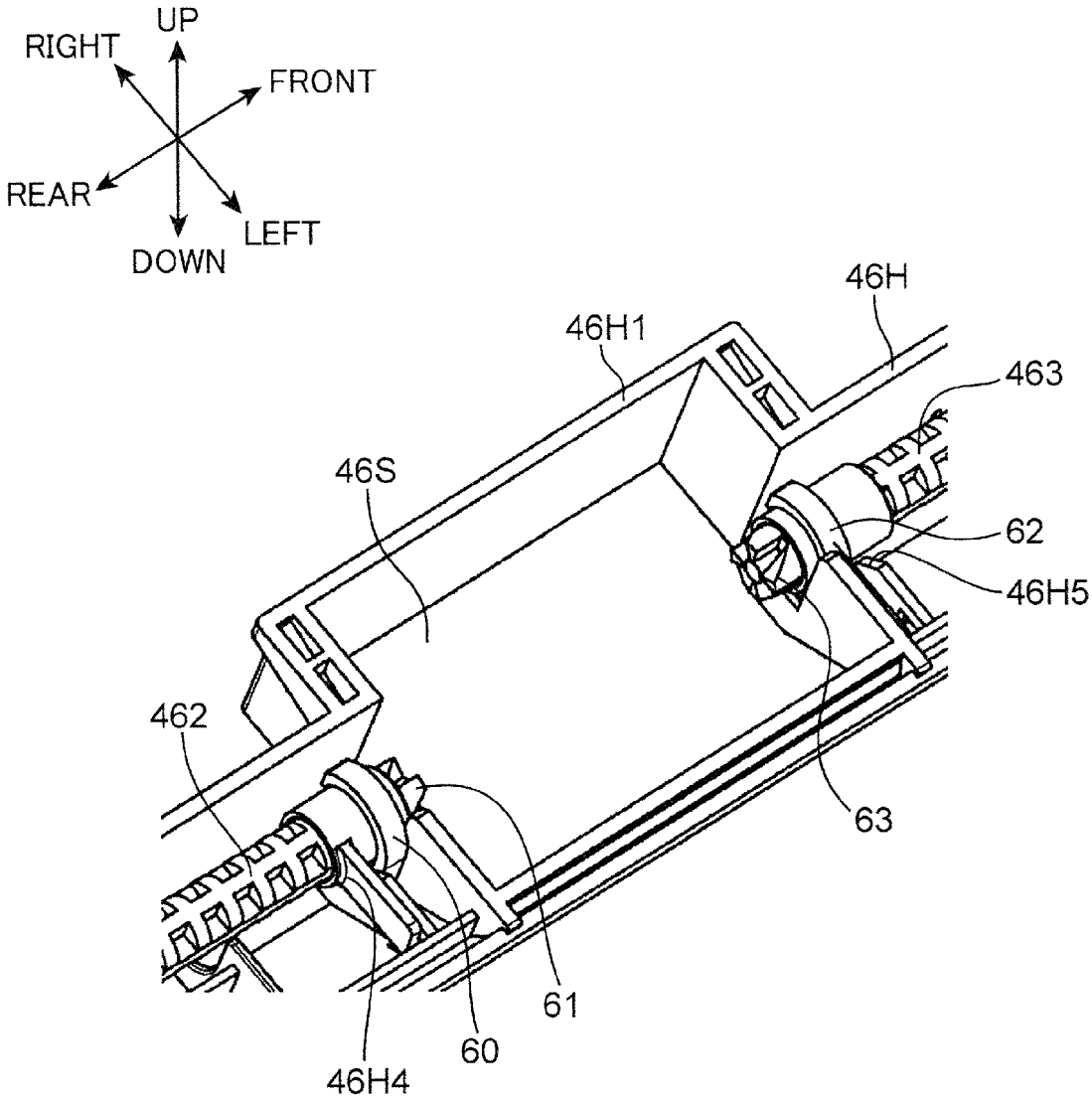
FIG. 6 is a partially enlarged perspective view of a housing in the first embodiment of the present disclosure.
Figure 7:
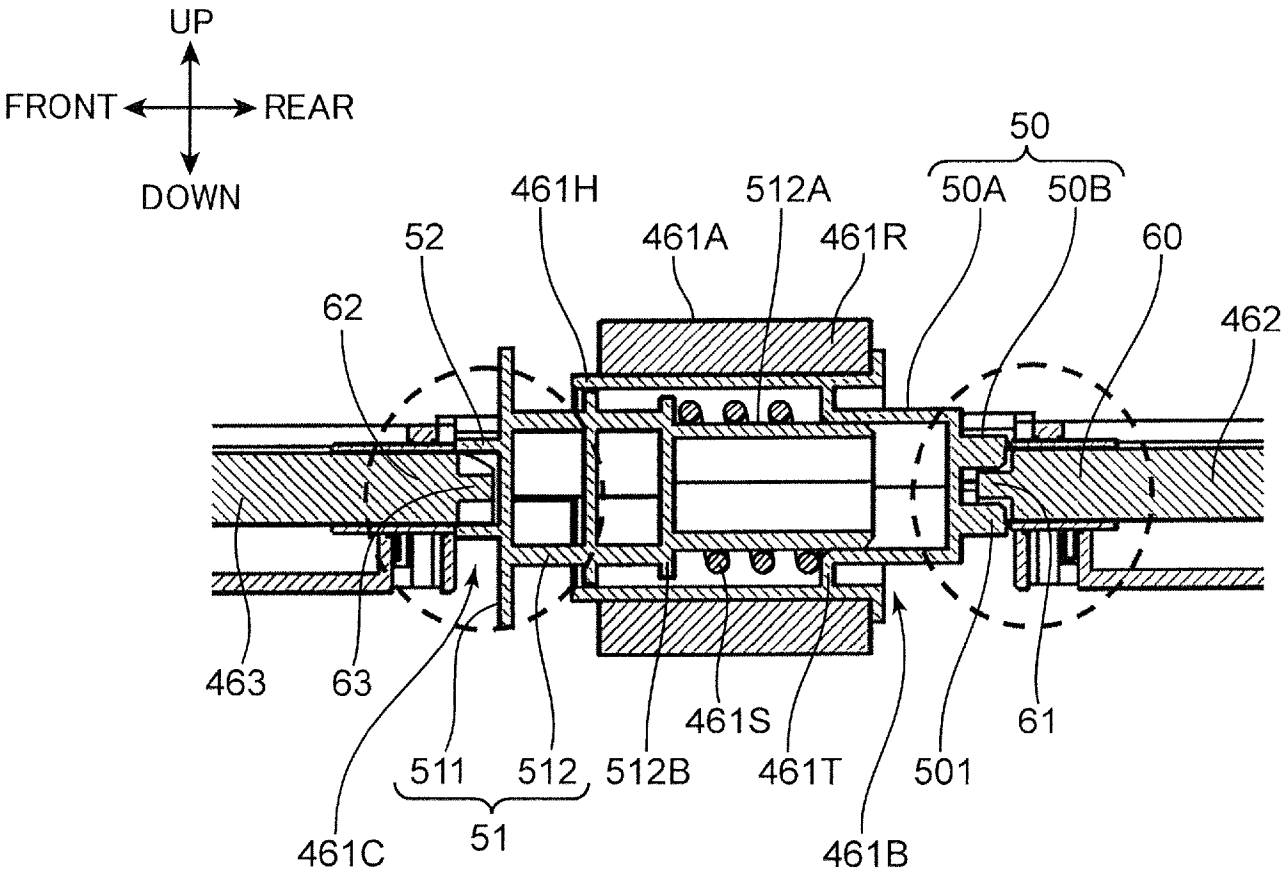
FIG. 7 is an enlarged sectional view of the conveyor roller, and first and second shafts in the first embodiment of the present disclosure.

In this section, the manual sheet feeding unit 46 according to the first embodiment of the present disclosure is described in details referring to FIGS. 2 to 7. FIG. 2 is a perspective view of the manual sheet feeding unit 46 according to the first embodiment. FIG. 3 is a perspective view of a housing 46H of the manual sheet feeding unit 46 and the vicinity thereof. FIG. 4 and FIG. 5 are perspective views of a sheet feeding roller 461. FIG. 6 is an enlarged perspective view of a mounting portion 46H1 of the housing 46H to which the sheet feeding roller 461 is mounted, and the vicinity thereof. FIG. 7 is an enlarged sectional view of the sheet feeding roller 461, a first drive shaft 462, and a second drive shaft 463.

Referring to FIG. 2 and FIG. 3, the manual sheet feeding unit 46 is provided with a body unit 100, the manual sheet feeding tray 46A, a manual lift plate 46B, width alignment guides 46C, the housing 46H, the sheet feeding roller 461, the first drive shaft 462 (a first shaft), the second drive shaft 463 (a second shaft), a first drive unit 71, and a second drive unit 72.

The body unit 100 is a housing to be disposed on the right surface 10R (see FIG. 1) of the apparatus body 10. The body unit 100 constitutes a part of the apparatus body 10. As illustrated in FIG. 2, the body unit 100 extends in front and rear directions with a certain width in left and right directions. The body unit 100 defines the lower side of the manual sheet conveyance path 460 (see FIG. 1) on the downstream side in the sheet conveyance direction than the manual sheet feeding tray 46A. A sheet is guided toward the left side and obliquely upwardly by the body unit 100 and by the housing 46H to be described later.

The manual sheet feeding tray 46A is a plate-shaped member openably and closably mounted on the body unit 100. The manual sheet feeding tray 46A is pivotally movable around the pivot portion 461A (see FIG. 1). A sheet is conveyed from the manual sheet feeding tray 46A in the arrow DP direction illustrated in FIG. 2 (in the sheet conveyance direction, also simply called as conveyance direction).

The manual lift plate 46B forms a part of the upper surface portion of the manual sheet feeding tray 46A, and is disposed on the left side (on the downstream side in the conveyance direction) of the manual sheet feeding tray 46A. The left end (the downstream end in the conveyance direction) of the manual lift plate 46B is movable up and down by an unillustrated drive mechanism. Up and down movement of the manual lift plate 46B allows the lead end of a sheet stack placed on the manual sheet feeding tray 46A to direct upwardly. According to the above configuration, the lead end of the uppermost sheet of the sheet stack comes into contact with the sheet feeding roller 461.

A pair of the width alignment guides 46C are disposed on the manual lift plate 46B in front and rear directions, and are configured to align the position of a sheet in the width direction. Each of the width alignment guides 46C is movable in front and rear directions along a guide groove 46B1 formed in the manual lift plate 46B via an unillustrated rack and pinion gear.

The housing 46H is constituted of a box-shaped member extending in front and rear directions. The housing 46H is disposed above the body unit 100. A lower end of the housing 46H defines the upper portion of the manual sheet conveyance path 460. In other words, a part of the manual sheet conveyance path 460 is formed between the housing 46H and the body unit 100. The housing 46H rotatably supports the sheet feeding roller 461 at a middle portion of the housing 46H in front and rear directions. The housing 46H is provided with the mounting portion 46H1, a first clutch 46H2, a second clutch 46H3, a first shaft support portion 46H4 (see FIG. 6), and a second shaft support portion 46H5 (see FIG. 6).

The mounting portion 46H1 has such a shape that the middle portion of the housing 46H in front and rear directions partially projects toward the right side. An insertion space 46S is formed in the mounting portion 46H1 for accommodating the sheet feeding roller 461. The insertion space 46S is opened toward the upper side and toward the lower side. The sheet feeding roller 461 is mounted in the insertion space 46S from above. The first clutch 46H2 is a clutch disposed at a rear end of the housing 46H. The first clutch 46H2 is connected with the first drive shaft 462 to be described later. Likewise, the second clutch 46H3 is a clutch disposed at a front end of the housing 46H. The second clutch 46H3 is connected with the second drive shaft 463 to be described later. The first shaft support portion 46H4 and the second shaft support portion 46H5 (see FIG. 6) are a pair of bearing portions respectively disposed in front of the insertion space 46S and behind the insertion space 46S. The first shaft support portion 46H4 rotatably supports the first drive shaft 462 to be described later. Further, the second shaft support portion 46H5 rotatably supports the second drive shaft 463 to be described later.

The sheet feeding roller 461 is disposed above the manual sheet conveyance path 460 at a position facing the manual sheet feeding tray 46A. The sheet feeding roller 461 is mountable and dismountable to and from the housing 46H. Referring to FIG. 4, the sheet feeding roller 461 is provided with a circumferential surface 461A (an outer circumferential surface), a first side portion 461B, and a second side portion 461C. The first side portion 461B is one of the side portions of the sheet feeding roller 461. Further, the second side portion 461C is the other of the side portions of the sheet feeding roller 461 on the side opposite to the first side portion 461B. The circumferential surface 461A is disposed between the first side portion 461B and the second side portion 461C. The circumferential surface 461A is configured to come into contact with the sheet. The sheet is conveyed by rotating the sheet feeding roller 461 in the arrow DR direction (see FIG. 3).

Referring to FIG. 4, FIG. 5, and FIG. 7, the sheet feeding roller 461 is provided with a roller portion 461R, a holder portion 461H, a movable portion 51, and a spring 461S (see FIG. 7).

The holder portion 461H is formed into a cylindrical shape. The holder portion 461H is configured such that a side end of the holder portion 461H constitutes the first side portion 461B. The holder portion 461H includes a hollow portion therein. The roller portion 461R is supported by the holder portion 461H, and is provided with the circumferential surface 461A. The roller portion 461R including the circumferential surface 461A is formed by disposing a cylindrical rubber member around the outer circumferential portion of the holder portion 461H. An insertion portion 512 of the movable portion 51 to be described later is inserted in the hollow portion of the holder portion 461H. A cylindrical portion 50 is disposed on a first roller side surface 461B1 (see FIG. 5), which is a side surface of the roller portion 461R and a side surface of the holder portion 461 H. The cylindrical portion 50 axially projects from the side surface of the holder portion 461H. The cylindrical portion 50 is provided with a base end portion 50A, and a engaging insertion portion 50B (an engaged portion). The engaging insertion portion 50B is disposed at a distal end of the base end portion 50A. The engaging insertion portion 50B is engageable with a first engaging portion 60 or a second engaging portion 62 to be described later. Specifically, the engaging insertion portion 50B is formed into a cylindrical shape, and internally includes a plurality of projection pieces 501 (claws) disposed along the circumferential direction of the engaging insertion portion 50B. The projection pieces 501 are engageable with a first engaging claw 61 or a second engaging claw 63 to be described later.

An opening T (see FIG. 4) is formed in a second roller side surface 461C1, which is the other of the side surfaces of the holder portion 461H. The insertion portion 512 of the movable portion 51 is inserted in the holder portion 461H through the opening T (see FIG. 7).

The movable portion 51 is configured such that a side end of the movable portion 51 constitutes the second side portion 461C. The movable portion 51 is mounted in the holder portion 461 H. In other words, the movable portion 51 forms one of the first side portion 461 B and the second side portion 461C of the sheet feeding roller 461, other than the side portion constituting the roller portion 461R. The movable portion 51 is slidably movable in the direction of axis of rotation of the sheet feeding roller 461 in the hollow portion of the holder portion 461H. The movable portion 51 is provided with a flange portion 511 and the insertion portion 512. The insertion portion 512 extends from the flange portion 511. An end of the insertion portion 512 corresponding to the flange portion 511 side is formed into a prismatic shape (see FIG. 4). A distal end (an insertion outer circumferential portion 512A) of the insertion portion 512 is formed into a substantially cylindrical shape. The insertion outer circumferential portion 512A is inserted in the hollow portion of the holder portion 461H. The flange portion 511 is a flange disposed on the axially outer side of the insertion portion 512. The flange portion 511 is configured to face the second roller side surface 461 C 1 of the roller portion 461R. When the flange portion 511 is held by the user of the sheet feeding roller 461, the movable portion 51 is slidably movable in the axis direction with respect to the holder portion 461H (see the arrow DS in FIG. 4). In performing the above operation, an unillustrated hook projecting radially outwardly from the insertion outer circumferential portion 512A is engaged with an unillustrated engaging piece formed on the inner circumferential surface of the holder portion 461H. Thus, the hook is provided with a function of locking the movable portion 51.

Further, the movable portion 51 is formed with the bearing portion 52. The bearing portion 52 projects axially outwardly from the flange portion 511 at the center portion of the flange portion 511. In other words, the bearing portion 52 is disposed on the second side portion 461C of the sheet feeding roller 461. As illustrated in FIG. 4 and FIG. 7, the bearing portion 52 is formed into a cylindrical shape including an inner space. The first engaging portion 60 or the second engaging portion 62 to be described later is inserted in the inner space of the bearing portion 52. According to the above configuration, the bearing portion 52 is rotatably and axially supported by the first engaging portion 60 or the second engaging portion 62 in relatively rotatable manner. The bearing portion 52 allows relative rotation of the first engaging portion 60 or the second engaging portion 62 to the sheet feeding roller 461.

The spring 461S (see FIG. 7) is a coil spring mounted on the insertion outer circumferential portion 512A in the hollow portion of the holder portion 461H. The spring 461S is compressively deformable between an inner wall portion 461T (see FIG. 7) of the holder portion 461H, and an inner flange portion 512B of the insertion portion 512. When the sheet feeding roller 461 is dismounted from the housing 46H, the movable portion 51 is slidably moved with respect to the holder portion 461H in such a manner that the entire axial length of the sheet feeding roller 461, i.e., the axial length between the first side portion 461B and the second side portion 461C decreases. In performing the above operation, the movable portion 51 is slidably moved, accompanied by compression of the spring 461S. On the other hand, when the sheet feeding roller 461 is mounted in the housing portion 46H, the holder portion 461H is slidably moved in the axis direction (in front and rear directions in FIG. 7) with respect to the movable portion 51 in such a manner that the entire axial length of the sheet feeding roller 461 increases. In performing the above operation, engagement between the engaging insertion portion 50B and the first engaging claw 61 to be described later is smoothly and securely implemented by the urging force of the spring 461S.

The first drive shaft 462 is mounted in the rear portion of the housing 46H. The first drive shaft 462 is axially supported on the first shaft support portion 46H4 (see FIG. 6) of the housing 46H, and is connected with the first clutch 46H2 (see FIG. 3). The first drive shaft 462 is a shaft extending in front and rear directions, and serves as a rotation shaft of the sheet feeding roller 461. The first drive shaft 462 is interconnected with the first side portion 461 B or the second side portion 461C of the sheet feeding roller 461. The first clutch 46H2 is provided with a first drive gear 464. In FIG. 3, the first drive gear 464 to be disposed behind the first clutch 46H2 is not illustrated. The first drive gear 464 is a gear to be connected with the first clutch 46H2. The first drive gear 464 is connected with a first drive unit 71 to be described later.

The first drive shaft 462 is further provided with the first engaging portion 60 (see FIG. 6). The first engaging portion 60 is disposed on the distal end of the first drive shaft 462 corresponding to the sheet feeding roller 461 side (the insertion space 46S side). The first engaging portion 60 is disposed toward the front side. The first engaging portion 60 is connectable with the engaging insertion portion 50B of the sheet feeding roller 461. The first engaging portion 60 is provided with the first engaging claw 61. The first engaging claw 61 is constituted of a plurality of claws disposed along the circumferential direction of rotation of the sheet feeding roller 461. The first engaging claw 61 is disposed to engage with the projection pieces 501 of the engaging insertion portion 50B. Further, the first engaging claw 61 of the first engaging portion 60 is insertable in the bearing portion 52 of the sheet feeding roller 461.

The second drive shaft 463 is mounted in the front portion of the housing 46H. The second drive shaft 463 is coaxially provided with the first drive shaft 462, and is disposed on the side opposite to the first drive shaft 46 with respect to the insertion space 46S. The second drive shaft 463 is axially supported on the second shaft support portion 46H5 (see FIG. 6) of the housing 46H, and is connected with the second clutch 46H3 (see FIG. 3). The second drive shaft 463 is a shaft extending in front and rear directions, and serves as a rotation shaft of the sheet feeding roller 461. The second drive shaft 463 is interconnected with the first side portion 461B or the second side portion 461C of the sheet feeding roller 461. Specifically, the second drive shaft 463 is interconnected with one of the first side portion 461B and the second side portion 461C, other than the side portion to be interconnected with the first drive shaft 462. The second clutch 46H3 is provided with a second drive gear 465. The second drive gear 465 is a gear to be connected with the second clutch 46H3. The second drive gear 465 is connected with the second drive unit 72 to be described later.

Further, the second drive shaft 463 is provided with the second engaging portion 62 (see FIG. 6). The second engaging portion 62 is disposed on the distal end of the second drive shaft 463 corresponding to the sheet feeding roller 461 side (the insertion space 46S side, the side opposite to the first engaging portion 60). The second engaging portion 62 is disposed toward the rear side. The second engaging portion 62 is connectable with the engaging insertion portion 50B of the sheet feeding roller 461. The second engaging portion 62 is provided with the second engaging claw 63. The second engaging claw 63 is constituted of a plurality of claws disposed along the circumferential direction of rotation of the sheet feeding roller 461. The second engaging claw 63 is disposed to engage with the projection pieces 501 of the engaging insertion portion 50B. Further, the second engaging claw 63 of the second engaging portion 62 is insertable in the bearing portion 52 of the sheet feeding roller 461.

The first drive unit 71 (see FIG. 3) (a drive unit) is a motor for generating a rotational driving force to rotate the sheet feeding roller 461. The first drive unit 71 is disposed in the body unit 100. The first drive unit 71 is connected with the first drive gear 464 to drive and rotate the first drive shaft 462 in a predetermined rotation direction (in the arrow DR direction in FIG. 3).

The second drive unit 72 (see FIG. 3) (a drive unit) is a motor for generating a rotational driving force to rotate the sheet feeding roller 461. The second drive unit 72 is disposed in the body unit 100. The second drive unit 72 is connected with the second drive gear 465 to drive and rotate the second drive shaft 463 in a predetermined rotation direction (in the arrow DR direction in FIG. 3).

As illustrated in FIG. 6, the sheet feeding roller 461 is mounted from above into the insertion space 46S of the mounting portion 46H1 in a state that the first drive shaft 462 and the second drive shaft 463 are mounted in the housing 46H in advance. As described above, the sheet feeding roller 461 is formed into a cylindrical shape. This may make it difficult for the operator to discriminate the first side portion 461B and the second side portion 461C of the sheet feeding roller 461 from each other. As a result, in some cases, the first side portion 461B is interconnected with the first drive shaft 462, and in other cases, the first side portion 461B is interconnected with the second drive shaft 463 depending on the operators. In the embodiment, it is possible to stably rotate the sheet feeding roller 461, no matter in which direction the sheet feeding roller 461 is mounted in the mounting portion 46H1.

Specifically, it is possible to mount the sheet feeding roller 461 in the housing 46H both in a first mounted state and in a second mounted state. The first mounted state (see FIG. 7) is a state, in which the operator mounts the sheet feeding roller 461 in the insertion space 46S so that the second side portion 461C faces toward the front side. Contrary to the state illustrated in FIG. 7, the second mounted state is a state, in which the operator mounts the sheet feeding roller 461 in the mounting portion 46H1 in such a manner that the first side portion 461B faces toward the front side.

In the first mounted state, the first drive shaft 462 is interconnected with the first side portion 461B, and the second drive shaft 463 is interconnected with the second side portion 461C. The sheet feeding roller 461 is integrally rotated with the first drive shaft 462 in the rotation direction (in the arrow DR direction in FIG. 3) by the rotational driving force generated in the first drive unit 71. On the other hand, in the second mounted state, the first drive shaft 462 is interconnected with the second side portion 461C, and the second drive shaft 463 is interconnected with the first side portion 461B. The sheet feeding roller 461 is integrally rotated with the second drive shaft 463 in the rotation direction by the rotational driving force generated in the second drive unit 72. According to the above configuration, it is possible to rotate the sheet feeding roller 461 in the predetermined rotation direction, no matter in which state the sheet feeding roller 461 is mounted in the housing 46H. Thus, it is possible to stably convey the sheet by the sheet feeding roller 461, while preventing rotation failure due to erroneous mounting of the sheet feeding roller 461, which is mountable and dismountable to and from the housing 46H.

In particular, in the first mounted state, engagement between the first engaging portion 60 and the engaging insertion portion 50B makes it possible to integrally rotate the first drive shaft 462 and the sheet feeding roller 461. Specifically, engagement between the first engaging claw 61 of the first engaging portion 60, and the projection pieces 501 of the engaging insertion portion 50B makes it possible to integrally rotate the first drive shaft 462 and the sheet feeding roller 461. Further, insertion of the second engaging claw 63 of the second engaging portion 62 into the inner space of the bearing portion 52 makes it possible to rotatably support the second side portion 461C side (the bearing portion 52) of the sheet feeding roller 461 on the second drive shaft 463 in relatively rotatable manner. In rotating the sheet feeding roller 461, a rotational driving force is not transmitted from the second drive shaft 463 to the sheet feeding roller 461. However, supporting the bearing portion 52 of the sheet feeding roller 461 on the rotating second drive shaft 463 makes it possible to stably retain the center of rotation of the sheet feeding roller 461.

On the other hand, in the second mounted state, engagement between the second engaging portion 62 and the engaging insertion portion 50B makes it possible to integrally rotate the second drive shaft 463 and the sheet feeding roller 461. Specifically, engagement between the second engaging claw 63 of the second engaging portion 62 and the projection pieces 501 of the engaging insertion portion 50B makes it possible to integrally rotate the second drive shaft 463 and the sheet feeding roller 461. Further, insertion of the first engaging claw 61 of the first engaging portion 60 into the inner space of the bearing portion 52 makes it possible to rotatably support the second side portion 461C side (the bearing portion 52) of the sheet feeding roller 461 on the first drive shaft 462 in relatively rotatable manner. In rotating the sheet feeding roller 461, a rotational driving force is not transmitted from the first drive shaft 462 to the sheet feeding roller 461. However, supporting the bearing portion 52 of the sheet feeding roller 461 on the rotating first drive shaft 462 makes it possible to stably retain the center of rotation of the sheet feeding roller 461, as well as the above case.

As described above, engagement between the first engaging portion 60 or the second engaging portion 62, and the engaging insertion portion 50B makes it possible to securely transmit the rotational driving force to the sheet feeding roller 461, and to stably rotate the sheet feeding roller 461. Further, the other of the first engaging portion 60 and the second engaging portion 62, which is not engaged with the engaging insertion portion 50B, is rotatably supported on the bearing 52. According to the above configuration, it is possible to stably rotate and support the sheet feeding roller 461 on both sides i.e. on the first side portion 461B side and on the second side portion 461C side both in the first mounted state and in the second mounted state.

Further, in the embodiment, the sheet feeding roller 461 includes the roller portion 461R, the holder portion 461H, and the movable portion 51. The movable portion 51 is slidably movable in the direction of axis of rotation of the sheet feeding roller 461 with respect to the holder portion 461H. The operator is allowed to insert the insertion portion 512 of the movable portion 51 into the hollow portion of the holder portion 461H, while compressing the spring 461S. Specifically, slidably moving the movable portion 51 in such a manner that the entire axial length of the sheet feeding roller 461 (the axial length between the first side portion 461B and the second side portion 461C) decreases makes it easy to implement mounting and dismounting (attaching and detaching) the sheet feeding roller 461 in and out of the insertion space 46S of the housing 46H.

Specifically, as described above, reducing the axial length between the first side potion 461 B and the second side portion 461C of the sheet feeding roller 461 in a state that the sheet feeding roller 461 is mounted in the insertion space 46S, and the sheet feeding roller 461 is interconnected with the first drive shaft 462 and the second drive shaft 463 makes it possible to release the interconnection between the sheet feeding roller 461, the first drive shaft 462, and the second drive shaft 463. More specifically, in the state illustrated in FIG. 7, the bearing portion 52 is disengaged from the second engaging claw 63, and the engaging insertion portion 50B is disengaged from the first engaging claw 61. According to the above configuration, it is possible to dismount the sheet feeding roller 461 from the housing 46H in a direction (radial direction) intersecting with the axis direction. It is possible to radially mount and dismount the sheet feeding roller 461 in and out of the insertion space 46S in a state that the sheet feeding roller 461 is inclined with respect to the axis direction, even if interconnection between one of the first drive shaft 462 and the second drive shaft 463, and the sheet feeding roller 461 is released.

Figure 8A:
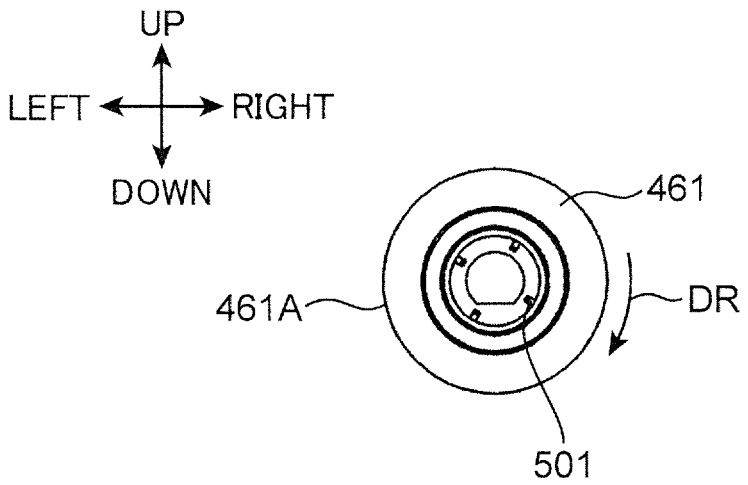
FIG. 8A is a front view of a conveyor roller according to the second embodiment of the present disclosure.
Figure 8B:
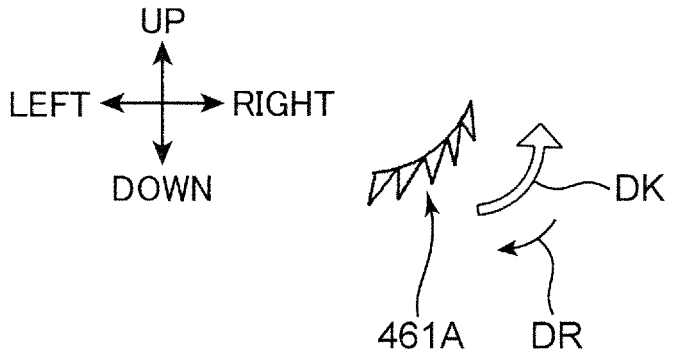
FIG. 8B is a schematic enlarged sectional view of the outer circumferential surface of the conveyor roller according to the second embodiment of the present disclosure.

In the following, a second embodiment of the present disclosure is described. The second embodiment is different from the first embodiment in the surface configuration of the sheet feeding roller 461. Accordingly, the difference is described, and description of the other features common between the first and second embodiments is omitted. FIGS. 8A and 8B are diagrams illustrating the surface configuration of a circumferential surface 461A of a sheet feeding roller 461. FIG. 8A is a front view of the sheet feeding roller 461. FIG. 8B is a partially enlarged view of the circumferential surface 461A. In the second embodiment, a predetermined polishing treatment is applied to the circumferential surface 461A. Specifically, as illustrated in FIG. 8A, the sheet feeding roller 461 is rotated in the arrow DR direction illustrated in FIGS. 8A and 8B, when the sheet feeding roller 461 is disposed in an insertion space 46S in the first state in such a manner that projection pieces 501 face toward the front side. In the manufacturing process of the sheet feeding roller 461, an unillustrated polishing member polishes the circumferential surface 461A made of a rubber material, while rotating in the circumferential direction as illustrated by the arrow DK in a state that the sheet fixing roller 461 is kept unmoved. According to the above configuration, as illustrated in FIG. 8B, the circumferential surface 461A is formed with polishing traces (asperities) along the circumferential direction.

Due to the polishing traces, the friction force (or the coefficient of friction) between the circumferential surface 461A of the sheet feeding roller 461 in the first mounted state and a sheet may be different from the friction force (or the coefficient of friction) between the circumferential surface 461A of the sheet feeding roller 461 in the second mounted state and the sheet. In the second embodiment, the coefficient of friction between the circumferential surface 461A of the sheet feeding roller 461 in the first mounted state and a sheet is set to be larger than the coefficient of friction between the circumferential surface 461A of the sheet feeding roller 461 in the second mounted state and the sheet. Accordingly, when thick paper is conveyed from a manual sheet feeding unit 46, selectively mounting the sheet feeding roller 461 in the first mounted state makes it possible to convey the thick paper with a large gripping force. On the other hand, when thin paper is conveyed from the manual sheet feeding unit 46 with a large gripping force, the thin paper may be creased with wrinkles. In view of the above, selectively mounting the sheet feeding roller 461 in the second mounted state for conveying thin paper makes it possible to convey the thin paper with a relatively small gripping force. In this way, in the second embodiment, selectively mounting the sheet feeding roller 461 in the first mounted state or in the second mounted state by the operator who is familiar with the structure of the sheet feeding roller 461 makes it possible to adjust the sheet conveying force. Further, in the second embodiment, as described above, it is possible to convey a sheet by the sheet feeding roller 461, while preventing rotation failure due to erroneous mounting of the sheet feeding roller 461, which is mountable and dismountable to and from the housing 46H, even when the operator is not familiar with the structure of the sheet feeding roller 461.

Figure 9:
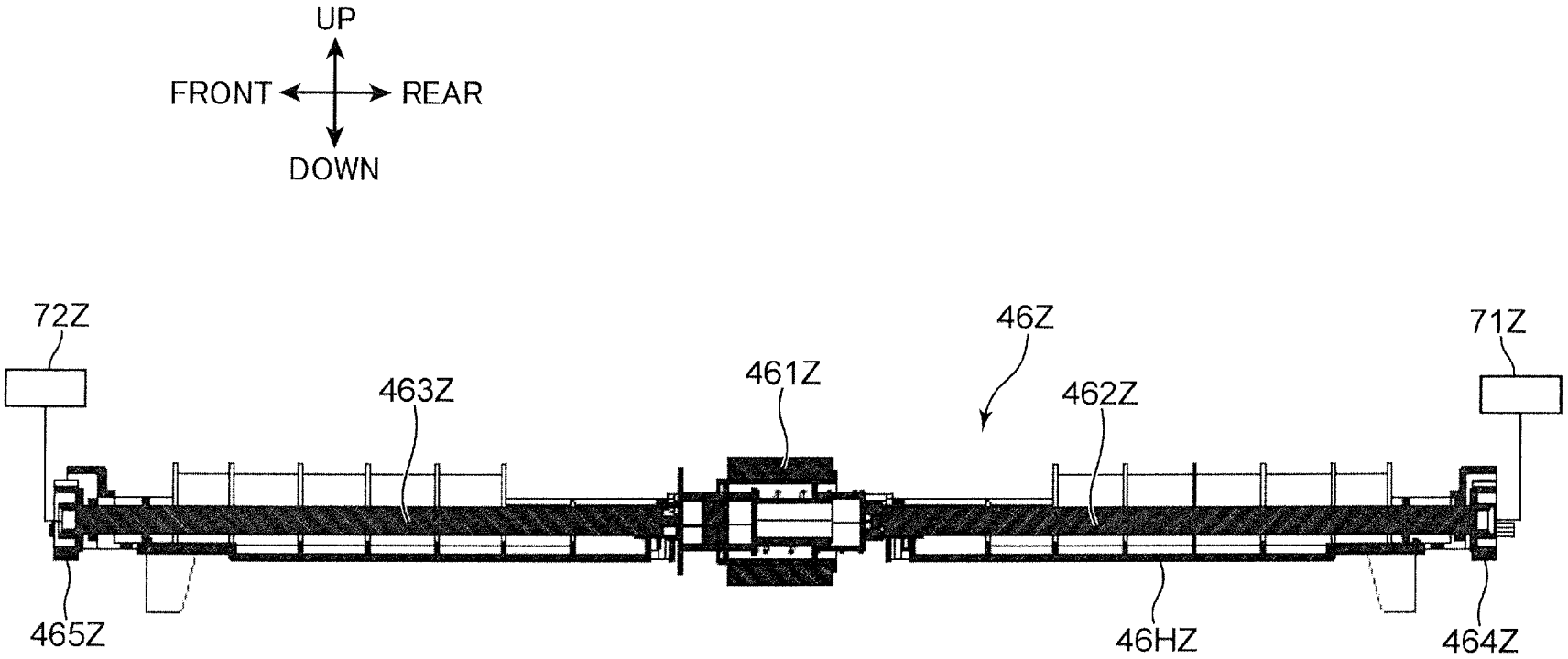
FIG. 9 is a sectional view of a conveyor roller, and first and second shafts including the vicinity thereof of a sheet feeding device according to the third embodiment of the present disclosure.

In the following, the third embodiment of the present disclosure is described. FIG. 9 is a cross-sectional view of a sheet feeding roller 461Z (a conveyor roller), a first drive shaft 462Z (a first shaft), a second drive shaft 463Z (a second shaft), and the vicinity thereof in a manual sheet feeding unit 46Z (a sheet feeding device) according to the third embodiment. The third embodiment is different from the first embodiment in the structure of a first drive gear 464Z and a second drive gear 465Z. Accordingly, the difference is described, and description of the other features common between the first and third embodiments is omitted.

In the third embodiment, the sheet feeding roller 461Z is mountable and dismountable to and from a housing 46HZ. A polishing treatment as applied in the second embodiment is not applied to the circumferential surface of the sheet feeding roller 461Z. Accordingly, the coefficient of friction of the circumferential surface is set to be substantially constant, no matter when the rotation direction of the sheet feeding roller 461Z is changed. Further, as well as the first embodiment, when the sheet feeding roller 461Z is mounted in the first mounted state as illustrated in FIG. 9, the rotational driving force of a first drive unit 71Z is transmitted to the first drive shaft 462Z via the first drive gear 464Z. According to the above configuration, the sheet feeding roller 461Z is integrally rotated with the first drive shaft 462Z. On the other hand, when the sheet feeding roller 461Z is mounted in the second mounted state by replacing the front side and the rear side of the sheet feeding roller 461Z from the state illustrated in FIG. 9, the rotational driving force of the second drive unit 72Z is transmitted to the second drive shaft 463Z via the second drive gear 465Z. According to the above configuration, the sheet feeding roller 461Z is integrally rotated with the second drive shaft 463Z.

In the third embodiment, the first drive unit 71Z and the second drive unit 72Z are respectively provided with unillustrated drive input shafts configured to rotate with the same number of rotations so as to input a rotational driving force to the first drive gear 464Z and to the second drive gear 465Z. On the other hand, the number of gear teeth formed on the circumferential surface of the first drive gear 464Z is different from the number of gear teeth formed on the circumferential surface of the second drive gear 465Z. This causes the rotational speed of the sheet feeding roller 461Z to be rotated by the first drive unit 71Z in the first mounted state to be different from the rotational speed of the sheet feeding roller 461Z to be rotated by the second drive unit 72Z in the second mounted state. In particular, in the third embodiment, the rotational speed of the sheet feeding roller 461Z to be rotated by the first drive unit 71Z in the first mounted state is set to be larger than the rotational speed of the sheet feeding roller 461Z to be rotated by the second drive unit 72Z in the second mounted state. Accordingly, selectively mounting the sheet feeding roller 461 in the first mounted state or in the second mounted state by the operator who is familiar with the structure of the manual sheet feeding unit 46Z makes it possible to adjust the sheet conveying speed. Thus, it is possible to stably supply sheets to the image forming unit 30 in the image forming apparatus 1 by changing the mounted state of the sheet feeding roller 461Z depending on the printing speed, even when different printing speeds (process speeds) are set in the image forming apparatus 1. Further, in the above configuration, even when the operator is not familiar with the structure of the manual sheet feeding unit 46Z, it is possible to stably convey the sheet by the sheet feeding roller 461Z, while preventing rotation failure due to erroneous mounting of the sheet feeding roller 461Z.

In the foregoing, the sheet feeding units 46 and 46Z, and the image forming apparatus 1 provided with the sheet feeding unit according to the embodiments of the present disclosure have been described. The present disclosure is not limited to the above. For instance, the following modifications may be applied.

(1) In the embodiments, the manual sheet feeding tray 46A serves as a sheet tray, and the manual sheet feeding unit 46 serves as a sheet feeding device. The present disclosure is not limited to the above. The present disclosure may be applied to the ADF 20 (a sheet feeding device) configured to convey sheets as documents. In the above modification, the reading unit 25 (a reading unit) and the ADF 20 constitute the image reading device 2. The reading unit 25 is disposed to face a sheet conveyance path extending from a document tray 21 (a sheet stacking unit). Disposing a conveyor roller which is mountable and dismountable to and from the ADF 20 makes it possible to stably convey documents toward the reading unit 25, while preventing rotation failure of the conveyor roller. Alternatively, documents whose images have been read by the reading unit 25 are stably conveyed by the conveyor roller.

(2) In the embodiments, the second side portion 461C side of the sheet feeding roller 461 including the bearing portion 52 is slidably moved with respect to the roller portion 461R as the movable portion 51. The present disclosure is not limited to the above. The first side portion 461B side of the sheet feeding roller 461 including the engaging insertion portion 50B may be slidably moved as the movable portion. Further, the sheet feeding roller 461 may not be provided with a movable portion which is slidably movable, and the first side portion 461B and the second side portion 461C may be formed on side surfaces of the sheet feeding roller 461. Further, the bearing portion 52 and the engaging insertion portion 50B may be disposed at positions other than the above. The second side portion 461C including the bearing portion 52 may be disposed on the holder portion 461H side, and the first side portion 461B including the engaging insertion portion 50B may be disposed on the movable portion 51 side.

(3) In the embodiments, the first drive unit 71 and the second drive unit 72 serve as drive units respectively connected with the first drive shaft 462 and the second drive shaft 463, and configured to drive and rotate the first drive shaft 462 and the second drive shaft 463 in a predetermined rotation direction. The present disclosure is not limited to the above. As one modification, a second drive unit 72 may be a drive transmission mechanism (a gear group) extending along a housing 46H in order to transmit a rotational driving force generated in a first drive unit 71 to a second drive gear 465. As another modification, an unillustrated motor may be disposed at the axially middle portion of a housing 46H below a sheet feeding roller 461. In the above modification, there are disposed a pair of drive transmission mechanisms for transmitting a rotational driving force from the motor to a first drive gear 464 and to a second drive gear 465. According to this configuration, it is possible to provide one drive motor configured to rotate the first drive shaft 462 and the second drive shaft 463. This is advantageous in reducing the cost required for the manual sheet feeding unit 46.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet feeding device, comprising:

a housing;

a conveyor roller mountable and dismountable to and from the housing, the conveyor roller including a first side portion, a second side portion on a side opposite to the first side portion, and an outer circumferential surface disposed between the first side portion and the second side portion and configured to come into contact with a sheet, the conveyor roller being driven and rotated in a predetermined rotation direction for conveying the sheet;

a first shaft rotatably and axially supported in the housing, the first shaft including a first engaging portion at a distal end thereof to be connectable with the first side portion or the second side portion of the conveyor roller;

a second shaft coaxially disposed with the first shaft, and rotatably and axially supported in the housing, the second shaft including a second engaging portion at a distal end thereof facing the first engaging portion to be connectable with the first side portion or the second side portion of the conveyor roller; and drive units respectively connected with the first shaft and the second shaft, and configured to drive and rotate the first shaft and the second shaft in the rotation direction, wherein the first side portion of the conveyor roller is formed with an engaged portion engageable with the first engaging portion or the second engaging portion for transmitting a rotational driving force from the first shaft or from the second shaft to the conveyor roller, the second side portion of the conveyor roller is formed with a bearing portion configured to be axially supported by the first engaging portion or the second engaging portion in relatively rotatable manner, and the conveyor roller is mountable to the housing both in a first mounted state, in which the engaged portion is engaged with the first engaging portion, and the bearing portion is supported by the second shaft in relatively rotatable manner so that the conveyor roller is integrally rotated with the first shaft in the rotation direction, and a second mounted state, in which the engaged portion is engaged with the second engaging portion, and the bearing portion is supported by the first shaft in relatively rotatable manner so that the conveyor roller is integrally rotated with the second shaft in the rotation direction.

2. The sheet feeding device according to claim 1, wherein the conveyor roller includes:

a holder portion including a hollow portion therein, a side end of the holder portion constituting one of the first side portion and the second side portion;

a roller portion supported on the holder portion and including the outer circumferential surface; and a movable portion mounted in the hollow portion of the holder portion, a side end of the movable portion constituting the other of the first side portion and the second side portion, and the movable portion is slidably supported in the hollow portion of the holder portion in a direction of axis of rotation of the conveyor roller.

3. The sheet feeding device according to claim 2, wherein the holder portion constitutes the first side portion of the conveyor roller, the movable portion constitutes the second side portion of the conveyor roller, the movable portion includes:

a flange portion; and an insertion portion extending from the flange portion and mounted in the hollow portion of the holder portion, the engaged portion is disposed on a side surface of the holder portion, and the bearing portion is disposed on the flange portion of the movable portion.

4. The sheet feeding device according to claim 1, wherein the first engaging portion and the second engaging portion are each constituted of a plurality of claws disposed along a circumferential direction of rotation of the conveyor roller, the engaged portion is constituted of a plurality of claws disposed along the circumferential direction and engageable with the claws of the first engaging portion or the second engaging portion, and the bearing portion is formed into a cylindrical shape, the bearing portion including an inner space in which the first engaging portion or the second engaging portion is inserted.

5. The sheet feeding device according to claim 1, wherein a friction force between the outer circumferential surface of the conveyor roller and the sheet in the first mounted state is different from a friction force between the outer circumferential surface of the conveyor roller and the sheet in the second mounted state.

6. The sheet feeding device according to claim 1, wherein the drive unit includes:

a first drive unit connected with the first shaft and configured to rotate the first shaft in the rotation direction; and a second drive unit connected with the second shaft and configured to rotate the second shaft in the rotation direction, and a rotational speed of the conveyor roller to be rotated by the first drive unit in the first mounted state is different from a rotational speed of the conveyor roller to be rotated by the second drive unit in the second mounted state.

7. An image forming apparatus, comprising:

an image forming unit which forms an image on a sheet; and the sheet feeding device of claim 1 which conveys the sheet.

8. An image reading device, comprising:

the sheet feeding device of claim 1 which conveys the sheet as a document; and a reading portion which reads an image of the document.

* * * * *